US005427359A

United States Patent [19]

Moulton

[11] Patent Number: 5,427,359

[45] Date of Patent: Jun. 27, 1995

[54] ERGONOMIC HANDRAIL/BUMPER

[75] Inventor: Paul Moulton, Williamsport, Pa.

[73] Assignee: Construction Specialties, Inc., Cranford, N.J.

[21] Appl. No.: 163,883

[22] Filed: Dec. 8, 1993

[51] Int. Cl.[6] ..... E04H 17/14

[52] U.S. Cl. ..... 256/59; 256/68

[58] Field of Search ..... 52/33, 174; 256/1, 59, 256/65, 68, 69

[56] References Cited

U.S. PATENT DOCUMENTS 5,165,643 11/1992 Shreiner ..... 256/59 X

*Primary Examiner*—Carl D. Friedman
*Assistant Examiner*—Creighton Smith
*Attorney, Agent, or Firm*—Brumbaugh, Graves, Donohue & Raymond

[57] ABSTRACT

An ergonomic handrail/bumper has an elongated metal retainer of substantially uniform cross-section along its length that is adapted to be mounted on a wall by supports. A bumper-retaining portion of the retainer includes a generally vertically oriented web, to which a handgrip-retaining portion spaced apart above the web is joined by a connecting portion. A bumper member is mounted on the front of the web of the bumper-retaining portion, and a handgrip member is mounted on the handgrip-retaining portion of the retainer. The handgrip-retaining portion has a base joined to the connecting portion, the base being inclined upwardly and rearwardly with respect to the front part of the bumper-retaining portion, and a pair of spaced apart retaining flanges extending generally upwardly from the base and defining a channel. The handgrip member is of a solid material and has surfaces engaging the base of the handgrip-retaining portion and a pair of grooves receiving the retaining flanges and defining a rib portion that is received in the channel of the handgrip-retaining portion of the retainer.

22 Claims, 5 Drawing Sheets

ERGONOMIC HANDRAIL/BUMPER

BACKGROUND OF THE INVENTION

One aspect of providing assistance to frail or physically handicapped individuals in various institutions, such as hospitals and nursing homes, is equipping the corridors and other spaces frequented by those individuals with handrails. The handrails are often integrated with bumper rails, inasmuch as the types of spaces in which handrails are installed commonly have a variety of food service and equipment carts, wheelchairs, litters and the like moving about the space. Bumper rails protect the walls from being marred or damaged due to impacts by moving equipment.

The assignee of the present invention and several other manufacturers of wall protection products have recently introduced ergonomic handrail/bumpers that consist of extruded aluminum retainers and cover members extruded from impact-resistant polymeric materials, such PVC, that are mounted on the retainers and provide attractive, durable surfaces. The handgrip portions are of circular cross-section, with a diameter of about 1.5 inch, which has been generally accepted to be the optimum size for enabling most frail or disabled people to get a good grip on the rail. Various building standards and codes have also established strength requirements for handrails, which presently available handrail/bumpers based on metal retainers and PVC-based covers usually meet. Examples of such handrail/-bumpers are described and shown in U.S. Pat. No. 5,165,643 (Shreiner, Nov. 24, 1992) and U.S. patent application Ser. No. 07/855,905 (Shreiner, Mar. 23, 1992).

Wood has long been a favored material for use in such building products as trim, paneling, railings, and moldings. Wood has come to represent, perhaps inherently or perhaps by custom, high quality and richness. Plastics and metals, on the other hand, with the possible exception of such costly metals as brass and bronze, are perceived by some people as being less rich and handsome in appearance than wood. Even plastics that are given a leatherette or wood grain appearance simply do not have the richness and aesthetic appeal of natural wood.

In addition to its good appearance, natural wood has the advantages of being a renewable resource and of being capable of being disposed of without damage to the environment. Plastics and metals, on the other hand, are not renewable resources, are costly to recycle and are not as readily disposed of as wood is. Wood is relatively easy to work and is relatively energy-efficient in terms of bringing it from the forest to the place of use.

As a material for wall railings and bumpers subject to impacts, natural wood is a poor choice. It is prone to denting and abrasion from impact, which ruins the appearance, frequently raises splinters and, when the damage is severe, presents a hazard to persons who touch the damaged areas. Wood also splits or splinters along edges under impacts near the edges. After repeated impacts, fasteners used to attach wood rails and bumpers to supports can loosen and fail, thereby allowing the rail or bumper to become dislodged from sound support.

Another material used in buildings is stone. Natural stone is not particularly well suited for handrails and bumpers because of its relatively low tensile strength, the difficulty of working it, and high cost in finished form. Artificial stone, on the other hand, can be molded to a desired shape and offers an opportunity to architects and designers to create wall protection products having a unique and rich appearance. Artificial stone materials are highly durable, and scratches can be polished away quite easily. Artificial stone, as used herein, refers to materials composed of powdered mineral fillers bound by a polymeric binder, such as a binder based on acrylic and carbonate monomers.

SUMMARY OF THE INVENTION

One object of the present invention is to provide an ergonomic handrail/bumper that has a solid, preferably round, handgrip member, which may be of wood, metal or artificial stone, and a wide bumper member spaced sufficiently far below the handrail member so that the user's thumb fits between the handgrip and bumper members, preferably at a frontally concave web portion. Another object is to provide a handrail that meets all current codes and industrial standards, especially those relating to the strength of the handgrip portion. Still a further object is to provide a handrail/bumper that affords to architects and interior designers the ability to use natural wood, metal, or artificial stone to attain the prized richness and high quality look that those materials provide. It is also an object of the invention to provide handrails of optimum utility in assisting feeble and physically handicapped persons.

The foregoing objects are attained, in accordance with the present invention, by an ergonomic handrail/-bumper comprising an elongated metal retainer of substantially uniform cross-section along its length that is adapted to be mounted on a wall in spaced-apart relation therefrom by means of supports. The retainer has in cross-section a bumper-retaining portion, a handgrip-retaining portion spaced apart above the bumper-retaining portion, and a connecting portion joining the bumper-retaining portion to the handgrip-retaining portion. A bumper member is mounted on the front of a vertical web of the bumper-retaining portion, and a handgrip member is mounted on the handgrip-retaining portion. The handgrip-retaining portion has a base joined to the connecting portion, the base being inclined upwardly and rearwardly with respect to the front part of the bumper-retaining portion, and a pair of spaced apart retaining flanges extending generally upwardly from the base and defining a channel. The handgrip member is of a solid material and has surfaces engaging the base of the handgrip-retaining portion and a pair of grooves receiving the retaining flanges and defining a rib portion that is received in the channel of the handgrip-retaining portion of the retainer.

The retainer provides a strong and rigid structural support for the handgrip member and bumper member. The orientation of the handgrip-retaining portion of the retainer provides strength and stiffness both vertically and horizontally and also enables it to be concealed from view by the handgrip member, inasmuch as it is located in a segment under and to the rear of the handgrip member. The mounting of the handgrip member by reception of a rib portion in a channel of the retainer provides large areas of surface contact between the retainer and handgrip member and a rib portion on the handgrip member of large cross-sectional area to resist shear. The oblique orientation of the channel and rib, moreover, minimizes shear forces acting on the rib. The base of the handgrip-retaining portion provides additional load support areas for the handgrip member against both horizontal and vertical load components.

In preferred embodiments, the rib portion of the handgrip member is in a close fit with the retaining flanges of the handgrip-retaining portion of the retainer, thus ensuring tightness and good-load transfer from the handgrip member to the retainer. Preferably, the side walls of the grooves opposite from the rib are in clearance from the retaining flanges of the handgrip-retaining portion. The clearance allows shrinking, swelling and warping of wood rails due to humidity changes to occur without stressing the segments of the handrail outwardly of the grooves with respect to the rib portion and makes those segments non load-bearing with respect to the retaining flanges. The rib of the handgrip member has an end surface that is in clearance from the base of the handgrip-retaining portion. The handgrip member may be made of wood, metal or artificial stone and may be affixed to the retainer by spaced apart screws passing through holes in the base of the handgrip-retaining portion and threaded into the handgrip member.

A particularly preferred configuration for the handgrip member is a cross-section bounded by a segment of a circle having an arc length of substantially more than 180 degrees and a chord of the circle. The surfaces of the handgrip member that engage the base of the handgrip portion are portions defined by the chord extending between the junctures of the chord with the circular arc and the grooves that define the attachment rib. The connecting portion of the retainer has a front surface that is concave and is connected to the handgrip portion at a juncture proximate to the juncture of the chord with the circle that is farthest from the wall. The base of the handgrip-retaining portion has a curved surface that adjoins and is a continuation of the circle of the handgrip portion.

The bumper member, preferably, has a front impact surface that is farther in front of the web than any part of the handgrip member so that impacts occur on the bumper member and not on the handrail but this is not essential. In one form, the bumper member is channel-shaped, has a front wall portion and upper and lower flange portions, and is formed of an impact resistant polymeric material. The bumper-retaining portion of the retainer has upper and lower flanges receiving the flange portions of bumper member and retaining the bumper member on the retainer.

In other embodiments, the bumper member is made of wood, metal or an artificial stone. The bumper-retaining portion of the retainer has on its front part spaced-apart upper and lower generally L-shaped flanges defining with the web upper and lower upwardly facing channels, and the bumper member has upper and lower downwardly facing ribs that are received in the respective channels such as to retain the bumper member on the retainer. Spaced apart screws passing through holes in the lower flange portion of the bumper-retaining portion and threaded into the bumper member retain the bumper member on the retainer. One or more rub strips, which may be made of metal, a durable polymeric material, or a pile fabric, can be secured to the front face of the bumper member. The rub strips, in addition to absorbing impacts and preventing damage to the bumper member itself, can be a decorative feature.

The manner in which the handgrip member and bumper member are attached to the retainer, in preferred embodiments as described above, permits them to be easily installed after the retainer is secured to the wall. Moreover, they can be easily removed from the retainer for refinishing or replacement.

For a better understanding of the invention, reference may be made to the following description of exemplary embodiments, taken in conjunction with the accompanying drawings.

DESCRIPTION OF THE EMBODIMENTS

Figure 1:
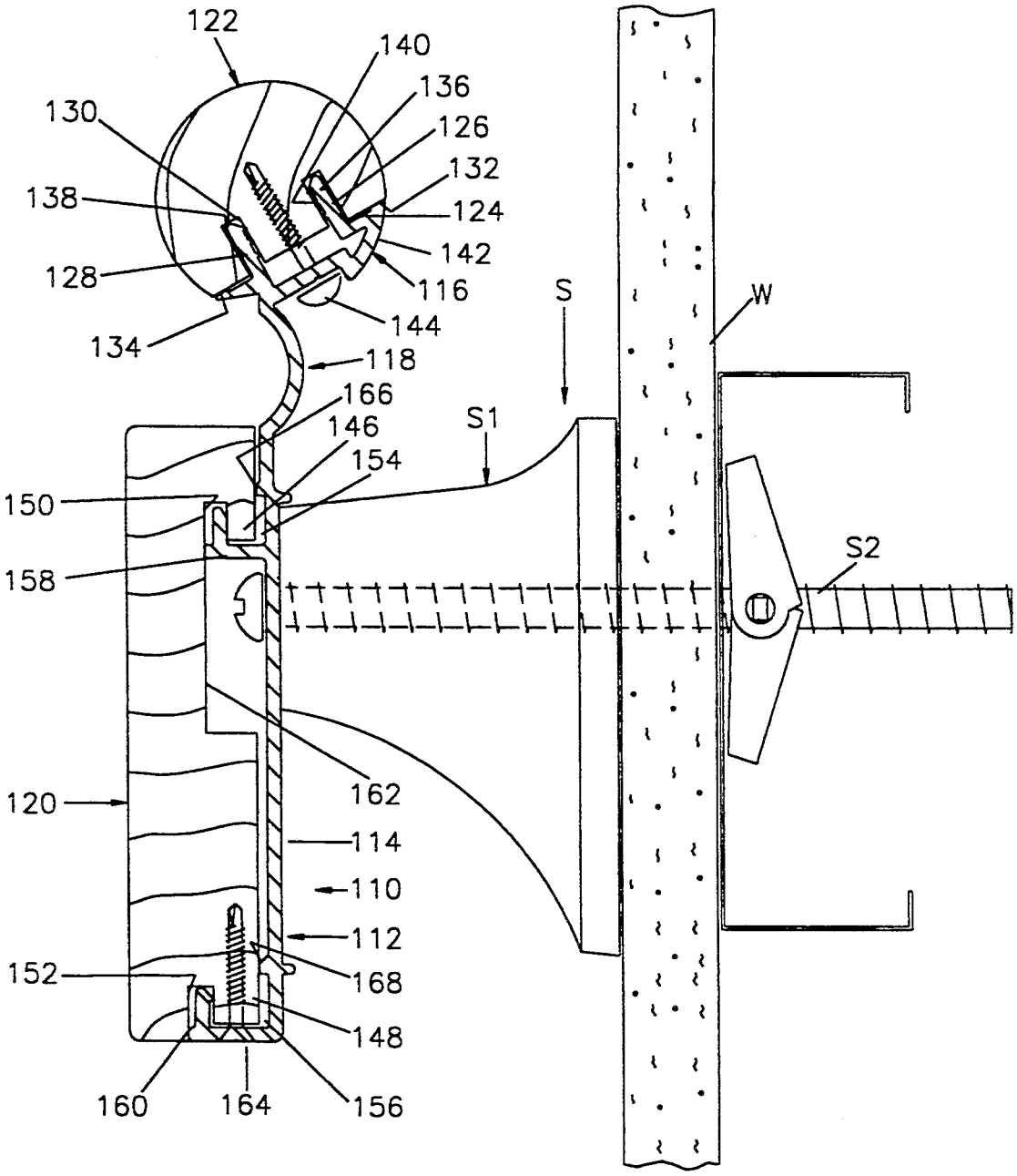
FIGS. 1 to 5 are end cross-sectional views of five embodiments, all of which are shown mounted on a wall.

The five embodiments are similar to each other in many respects. Accordingly, the reference numerals applied to the corresponding components of all embodiments have the same second and third digits, and the first digit, 1, 2, 3, etc., designates a particular embodiment in correspondence to the respective FIG. number, 1, 2, 3, etc. The embodiment of FIG. 1 is described below in detail, and that description applies to all embodiments except to the extent that differences between them are described below.

The handrail/bumper shown in FIG. 1 includes an elongated metal retainer 110 of substantially uniform cross-section along its length and adapted to be mounted on a wall W in spaced-apart relation therefrom by means of supports S, which include a spacer S1 and a toggle bolt S2. The retainer 110 has in cross-section a bumper-retaining portion 112 that includes a generally vertically oriented web 114, a handgrip-retaining portion 116 spaced apart above the web, and a connecting portion 118 joining the web to the handgrip-retaining portion. A bumper member 120 is mounted on a front part of the bumper-retaining portion 112, and a handgrip member 122 is mounted on the handgrip-retaining portion 116. The handgrip-retaining portion 116 has a base 124 joined to the connecting portion 118, the base being inclined upwardly and rearwardly with respect to the front part of the bumper-retaining portion, and a pair of spaced-apart retaining flanges 126 and 128 extending generally upwardly from the base and defining a channel 130 between them. The handgrip member 122 is of a solid material and has surfaces 132 and 134 engaging the base 124 of the handgrip-retaining portion and a pair of grooves 136 and 138 receiving the respective retaining flanges 126 and 128 and defining a rib portion 140 that is received in the channel 130 of the handgrip-retaining portion 116.

The handgrip member 122 is fabricated from wood, a hardwood such as oak, maple or cherry being preferred. In cross-section, it is defined by a circular arc of a circumferential extent of somewhat more than 180 degrees and a chord of the arc, which presents the surfaces 132 and 134 that bear against the base 124 on either side of the flanges 126 and 128. The arc surface has a diameter of about 1.5 inch, which as mentioned above is deemed to be optimum for most people to get a good firm grip on. A surface 142 on the base 116 adjoining the handgrip member 122 at the back is an arc of the same diameter as the arc of the handgrip member and provides an additional gripping area for the user. The connecting portion 118 of the retainer is curved so as to present a frontal surface that accepts the user's thumb.

The rib 140 forms a tight fit with the inner surfaces of the flanges 126 and 128 and, optionally, has teeth that enhance the engagement. The outer surfaces of the flanges 126 and 128 are in clearance with the facing walls of the corresponding grooves 136 and 138. The clearances, for one thing, permit swelling, shrinking, and warping of the wood member resulting from humidity changes without stressing the segments of the member laterally outwardly of the flanges. Also, the clearances eliminate undesirable areas of load transfer from the handgrip member to the retainer, namely loads tending to cause shear stresses acting along relatively small cross-sections between the respective grooves 136 and 138 and nearby external surfaces. Vertically downward loads on the handgrip member are shared by the engaging surfaces of the rib 140 and the flange 128 and the surfaces 132 and 134. Horizontal loads on the handgrip member are shared by the engaging surfaces of the rib 140 and the flange 126 and the surfaces 132 and 134. The load transfers at the aforementioned surfaces are primarily orthogonal to the surfaces and result in loads that act in shear along relatively large surface areas of the handgrip member; loads acting in shear along planes of relatively small area of the rail member are minimized, as will be apparent to those skilled in the art.

The handgrip member is secured to the retainer by spaced-apart screws 144 that pass through holes in the base 124 and thread into the handgrip member. The mounting arrangement for the handgrip member permits it to be installed on the retainer after the retainer is attached to the wall. The handgrip member can be easily detached from the retainer for refinishing or replacement by removing the screws and simply lifting it off the retainer.

The orientation and shape of the base 124 of the handgrip-retaining portion 116 of the retainer provide strong support for the handgrip member, the base being the primary load-carrying component of the handgrip system.

Instead of using wood for the handgrip member, a handgrip member can be molded from an artificial stone material.

The bumper member 120 of the embodiment shown in FIG. 1 is also fabricated from wood and is generally rectangular in cross-section. It is mounted on the front part of the bumper-retaining portion 112 of the retainer 110 by reception of upper and lower downwardly facing ribs 146 and 148, each of which is defined by a groove 150 and 152, respectively, in the bumper member, in upper and lower channels 154 and 156 defined by upper and lower L-shaped retaining flanges 158 and 160 on the retainer 110. The upper rib 146 is spaced apart below the upper edge of the bumper member and is located in a groove 162 in the back face of the member. The groove is of a vertical height such that the bumper member can be installed by positioning it above its final vertical position on the retainer, pushing it toward the web 114 and sliding it down into its installed position. Screws 164 installed from below through the lower retaining flange 160 retain the bumper member on the retainer. The mounting arrangement permits the bumper member to be installed on the retainer after the retainer is attached to the wall and also allows it to be removed from the retainer for refinishing or replacement without detaching the retainer from the wall.

The retainer 110 and bumper member 120 are configured and dimensioned such that the front face of the bumper member is farther from the wall W that the outermost surface of the handgrip member 122 so that impacts of carts and the like on the handrail/bumper are against the bumper member. The loads acting on the bumper member are primarily horizontal in the direction of the wall. Beads 166 and 168 on the front of the web 114 located, respectively, above the ribs 154 and 156 transfer the loads to the retainer and ensure against load transfers that produce shear stresses on the ribs that might cause them to fracture. The beads also provide clearances between the bumper member and the web that permit the bumper member to swell, shrink and warp due to changes in humidity. The lower flange 164 of the retainer is in clearance with the groove 152 to prevent load transfers that might cause cracking or fracture of the lower front segment of the bumper member between the front of the bumper member and the flange 164.

The bumper member of the embodiment of FIG. 1 can be fabricated from a molded artificial stone material instead of wood.

Figure 2:
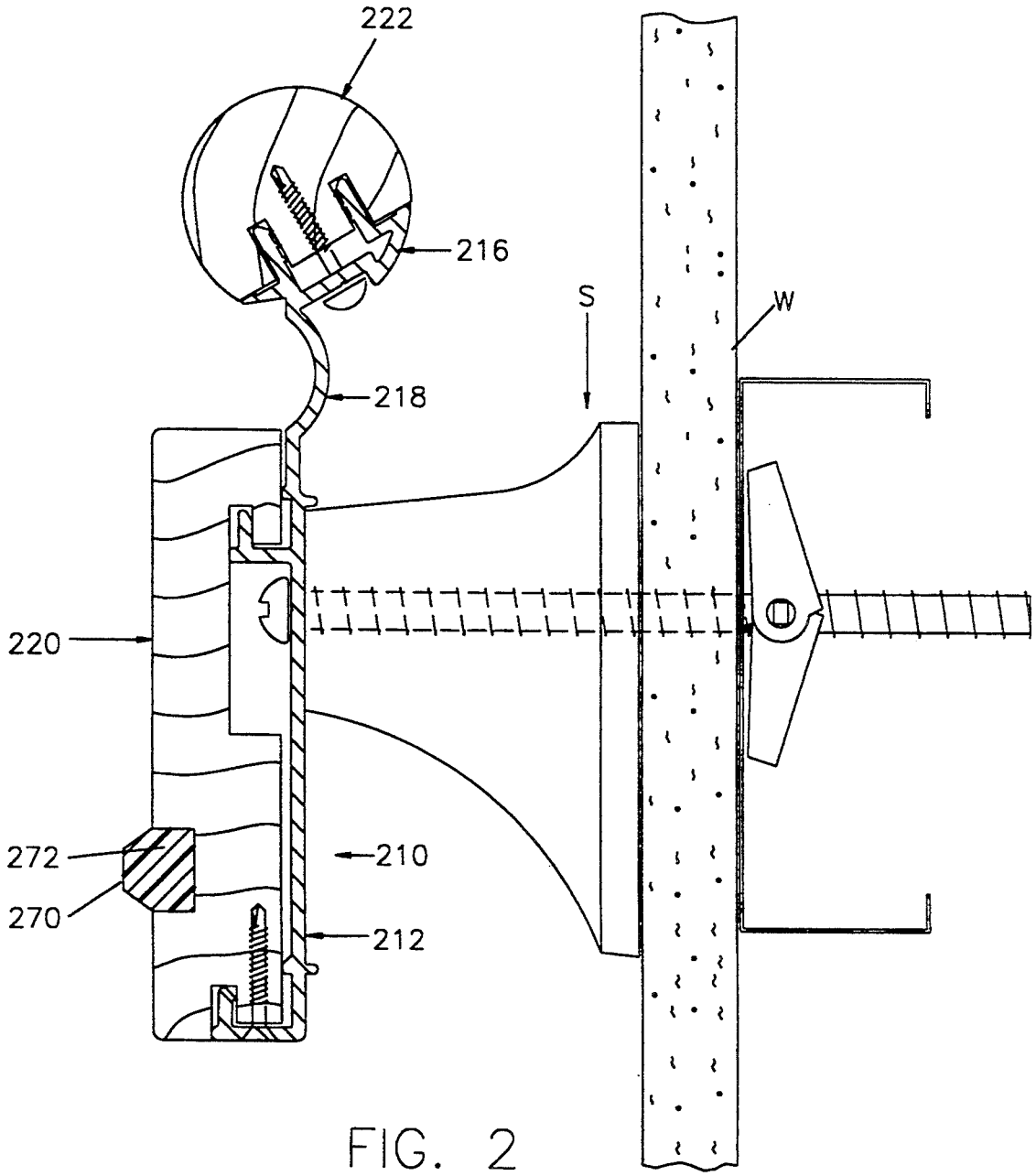

The embodiment shown in FIG. 2 is the same as that of FIG. 1 except that the bumper member 220 has a rub rail 270 installed in a groove 272 in the front face. The rub rail can be made of a metal, an impact resistant polymeric material, an elastomer, or an artificial stone material and can be secured to the bumper member by an adhesive.

Figure 3:
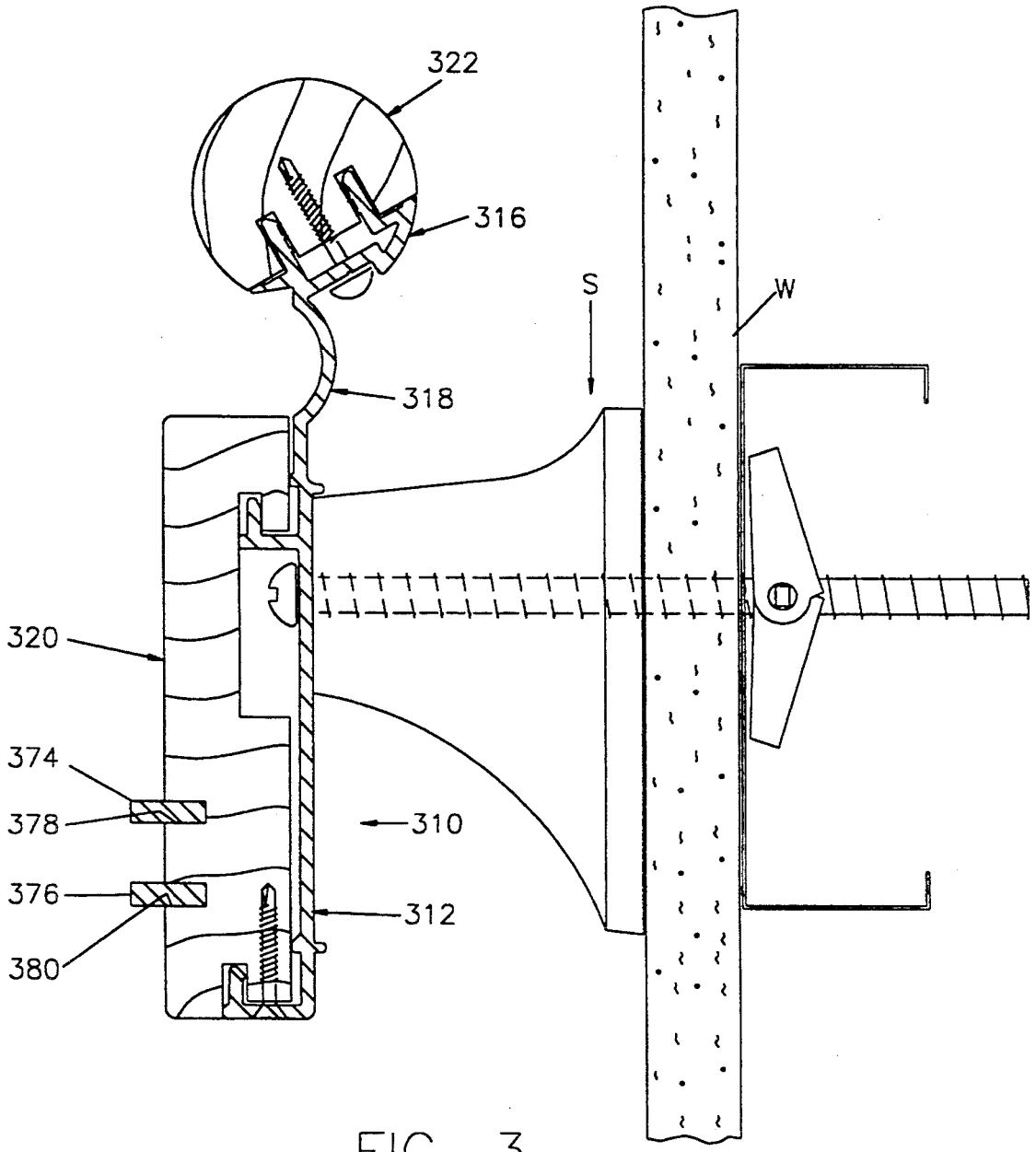

The embodiment shown in FIG. 3 is the same as that of FIG. 1 except that the bumper member 320 has two rub rails 374 and 376 installed in grooves 378 and 380 in the front face. The rub rails can be made of a metal, an impact resistant polymeric material, an elastomer, or an artificial stone material and can be secured to the bumper member by an adhesive.

Figure 4:
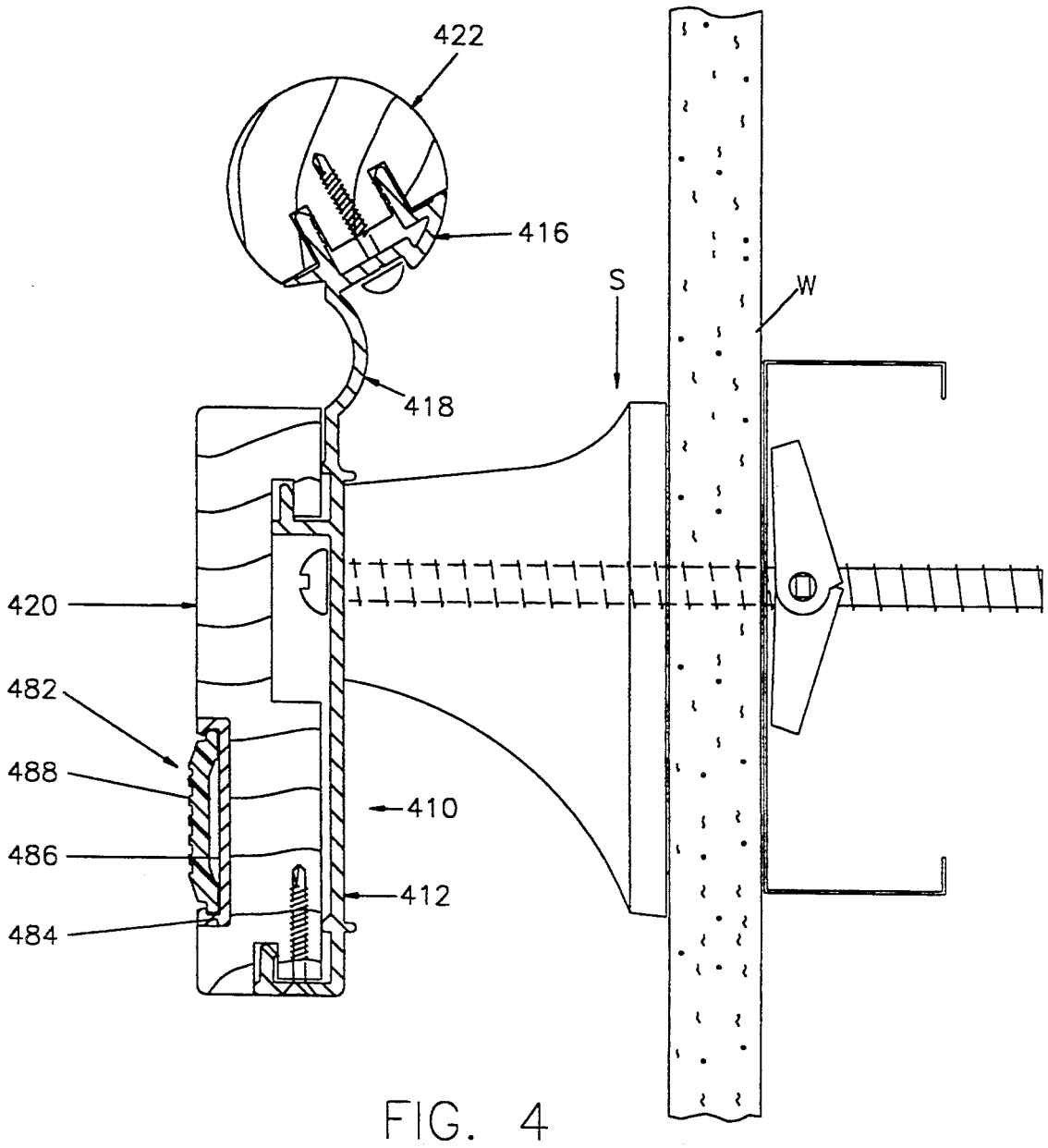

The embodiment shown in FIG. 4 is the same as that of FIG. 1 except that the bumper member 420 has a rub rail 482 installed in a groove 484 in the front face. The rub rail 482 consists of a channel member 486 of uniform cross-section along its length and a rub strip 488 installed in the channel member. The rub strip may be made of an impact resistant polymeric material, an elastomer or a pile fabric, such as a band of carpet. The side flange portions of the channel are undercut to receive the edges of the rub strip in a manner that retains the rub strip without an adhesive, but the rub strip can also be fastened to the channel by an adhesive. The channel can be fastened to the bumper member by an adhesive or by screws. The rub strip can be removed from the channel and replaced.

The rub rails of the bumper members of FIGS. 2 to 4 provide decorative accents as well as surfaces that receive impacts and protect the bumper members from marring. Rub rails of polymeric materials or carpet may be color-coded to indicate pathways in a building or colored to coordinate with decorative features of the place where they are installed. Decorative or color-coded bands can be applied to the outer surface of the connecting portion (e.g., 118) of the retainer of any of the embodiments.

Figure 5:
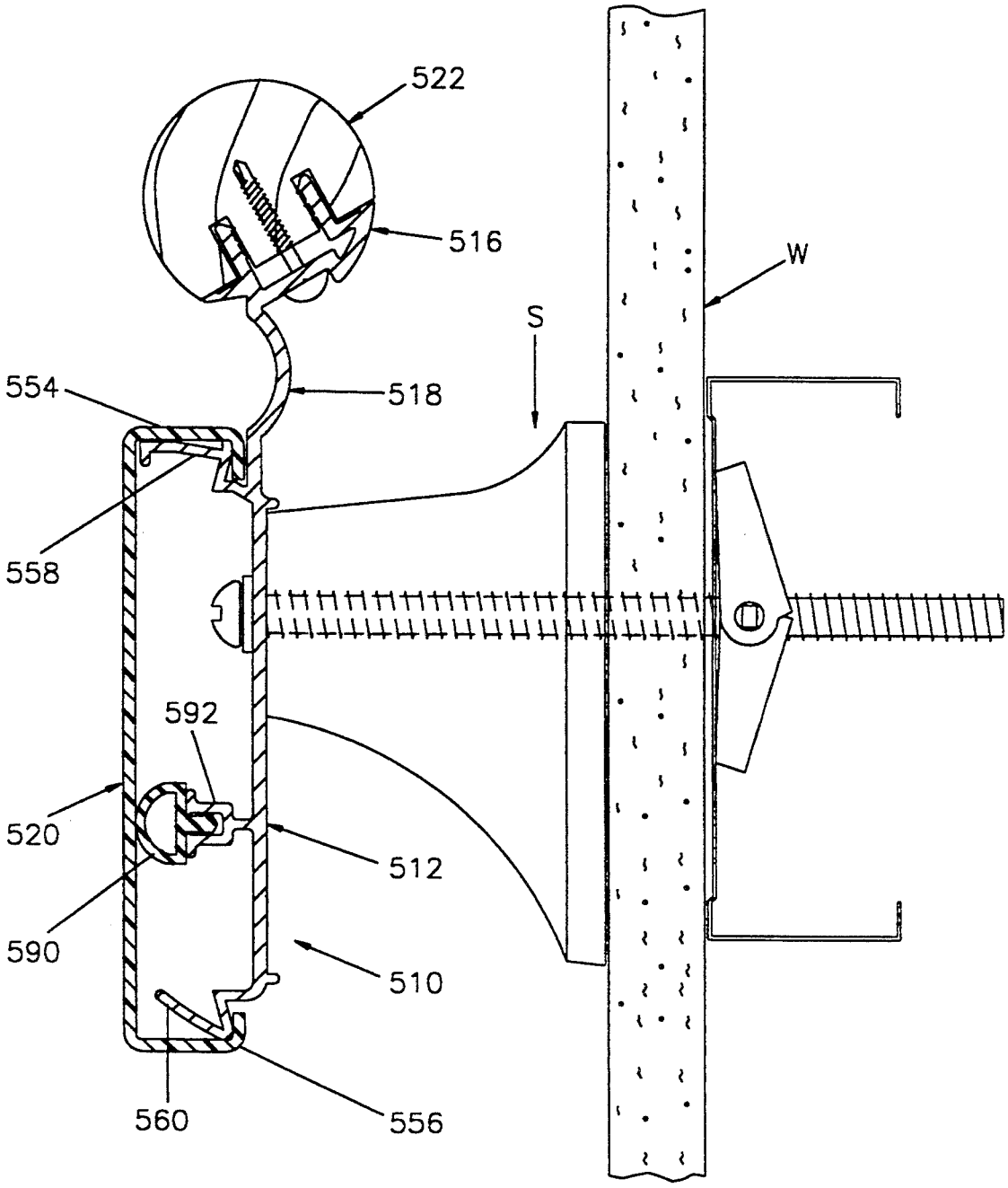

The bumper member 520 of the embodiment shown in FIG. 5 is a length of an extrusion of an impact resistant polymeric material, such as a blend that is primarily polyvinyl chloride and has a small amount of an acrylic polymer added. The bumper member is mounted on the front part of the bumper-retaining portion 512 of the retainer 510 by capturing of upper and lower L-shaped flanges 554 and 556 on the bumper member behind upper and lower retaining flanges 558 and 560 on the retainer 510. The bumper member is sufficiently resilient to enable it to be installed on the retainer by hooking the upper flange 554 of the bumper member over the upper retaining flange 558 and then pushing the lower portion of the bumper member toward the wall. The curved portion of the lower retaining flange of the retainer acts as a cam on the tip of the flange 556 by deflecting it downwardly, thereby deforming the bumper member widthwise so that the flange 556 slides past the retaining flange 560 and snaps into captured relation behind the lower retainer flange 560. A longitudinally continuous cushion 590 mounted on an arm 592 of the retainer helps maintain the front face of the bumper member flat and also cushions impacts to the bumper member. The bumper member can be made in a desired color for coding building areas and pathways or to coordinate with a decorative scheme. The bumper member of FIG. 5 is highly resistant to abrasion and marring and absorbs impacts by deformation and by deflection relative to the retainer.

I claim:

1. An ergonomic handrail/bumper comprising an elongated metal retainer of substantially uniform cross-section along its length and adapted to be mounted on a wall in spaced-apart relation therefrom on supports and having in cross-section a bumper-retaining portion that includes a generally vertically oriented web, the web having a front part, a handgrip-retaining portion spaced apart above the web, and a connecting portion joining the web to the handgrip-retaining portion, a bumper member mounted on the front part of the web of the bumper-retaining portion, and a handgrip member mounted on the handgrip-retaining portion, the handgrip-retaining portion having a base joined to the connecting portion, the base being inclined upwardly and rearwardly with respect to the front part of the web of the bumper-retaining portion, and a pair of spaced apart retaining flanges extending generally upwardly from the base and defining a channel, and the handgrip member being of a solid material and having surfaces engaging the base of the handgrip-retaining portion and a pair of grooves receiving the retaining flanges and defining a rib portion that is received in the channel of the handgrip-retaining portion of the retainer.

2. A handrail/bumper according to claim 1 wherein the rib portion of the handgrip member is in a close fit with the retaining flanges of the handgrip-retaining portion of the retainer.

3. A handrail/bumper according to claim 2 wherein the grooves have walls opposite from the rib portion that are in clearance from the retaining flanges of the handgrip-retaining portion.

4. A handrail/bumper according to claim 2 wherein the rib portion of the handgrip member has an end surface that is in clearance from the base of the handgrip-retaining portion.

5. A handrail/bumper according to claim 1 wherein the handgrip member is of a material selected from the group consisting of wood, metal and artificial stone.

6. A handrail/bumper according to claim 5 and further comprising spaced apart screws passing through holes in the base of the handgrip-retaining portion and threaded into the handgrip member such as to removably affix the handgrip member to the retainer.

7. A handrail/bumper according to claim 5 wherein the handgrip member in cross-section is bounded by a segment of a circle having an arc length of substantially more than 180 degrees and a chord of the circle.

8. A handrail/bumper according to claim 7 wherein the surfaces of the handgrip member that engage the base of the handgrip portion are portions defined by the chord extending between the junctures of the chord with the circular arc and the grooves.

9. A handrail/bumper according to claim 7 wherein the connecting portion is connected to the handgrip portion at a juncture proximate to the juncture of the chord with the circle that is farthest from the wall.

10. A handrail/bumper according to claim 7 wherein the base of the handgrip-retaining portion has a curved surface that adjoins and is a continuation of the circle of the handgrip portion.

11. A handrail/bumper according to claim 1 wherein the connecting portion of the retainer has a concave surface facing in the direction of the front part of the web.

12. A handrail/bumper according to claim 1 wherein the bumper member has a front impact surface that is farther in front of the web than any part of the handgrip member.

13. A handrail/bumper according to claim 1 wherein the bumper member is channel-shaped, has a front wall portion and upper and lower L-shaped flange portions, and is formed of an impact resistant polymeric material, and the bumper-retaining portion of the retainer has upper and lower retaining flanges receiving the L-shaped flange portions of the bumper member and retaining the bumper member on the retainer.

14. A handrail/bumper according to claim 1 wherein the bumper member is of a material selected from the group consisting of wood and an artificial stone.

15. A handrail/bumper according to claim 14 wherein the bumper-retaining portion of the retainer has on its front part spaced-apart upper and lower generally L-shaped flanges defining with the web of the retainer upper and lower upwardly facing channels, and wherein the bumper member has upper and lower downwardly facing ribs that are received in the respective channels such as to retain the bumper member on the retainer.

16. A handrail/bumper according to claim 15 and further comprising spaced apart screws passing through holes in the lower flange portion of the bumper-retaining portion and threaded into the bumper member.

17. A handrail/bumper according to claim 15 wherein the bumper member has a recess in its rear surface, the recess having an upper wall spaced apart from an upper edge of the bumper member, and the upper rib is a portion of the upper wall of the recess.

18. A handrail/bumper according to claim 17 wherein the recess has a lower wall that is spaced apart from the upper wall by a distance greater than a maximum vertical dimension of either of the L-shaped flanges.

19. A handrail/bumper according to claim 15 wherein the bumper member has a front face, and a rub strip is affixed to the bumper member and includes a portion projected forwardly from the front face.

20. A handrail/bumper according to claim 19 wherein the rub strip is of a material selected from the group consisting of metals, polymers, and pile fabrics.

21. A handrail/bumper according to claim 20 wherein the rub strip has a portion set into a groove in the bumper member.

22. A handrail/bumper according to claim 21 wherein the rub strip includes a metal channel set into the groove and a band received in the channel.

* * * * *